US006367109B1

(12) United States Patent
Besel et al.

(10) Patent No.: US 6,367,109 B1
(45) Date of Patent: Apr. 9, 2002

(54) FLOOR CLEANING APPARATUS HAVING A FLOATING BRUSH

(75) Inventors: Arlen Dale Besel, Elkton, MD (US); Davis Emerson Lee, Kennesaw, GA (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 09/500,837

(22) Filed: Feb. 10, 2000

(51) Int. Cl.[7] ..... A47L 11/283
(52) U.S. Cl. ..... 15/50.1; 15/49.1
(58) Field of Search ..... 15/49.1, 50.1

(56) References Cited

U.S. PATENT DOCUMENTS

| | | | | | |
|---|---|---|---|---|---|
| 2,317,843 | A | * | 4/1943 | Backlund | 15/50.1 |
| 2,671,920 | A | * | 3/1954 | Finnell | 15/50.1 X |
| 2,999,258 | A | * | 9/1961 | Berberian | 15/50.1 |
| 3,381,326 | A | * | 5/1968 | Dolan et al. | 15/50.1 X |
| 3,623,177 | A | * | 11/1971 | Pack | 15/50.1 X |
| 4,186,459 | A | * | 2/1980 | Wulff | 15/49.1 X |
| 4,339,840 | A | | 7/1982 | Monson | 15/321 |
| 4,391,548 | A | | 7/1983 | Malish | 403/348 |
| 4,510,643 | A | | 4/1985 | Kitada | 15/320 |
| 5,438,728 | A | | 8/1995 | Kubes et al. | 15/180 |
| 5,477,580 | A | | 12/1995 | Buysse | 15/180 |
| 5,517,715 | A | | 5/1996 | Monson | 15/320 |
| 5,522,114 | A | | 6/1996 | Allison | 15/320 |
| 5,575,710 | A | | 11/1996 | Kramer | 451/350 |
| 5,587,021 | A | | 12/1996 | Hoersch et al. | 134/1 |
| 5,623,743 | A | | 4/1997 | Burgoon et al. | 15/320 |
| 5,711,051 | A | | 1/1998 | Roden | 15/321 |
| 5,865,374 | A | | 2/1999 | Barta et al. | 239/263.1 |
| 6,052,854 | A | | 4/2000 | Besel et al. | 15/50.1 |

FOREIGN PATENT DOCUMENTS

| | | | | |
|---|---|---|---|---|
| DE | 640875 | * | 1/1937 | 15/49.1 |
| GB | 2042331 | * | 9/1980 | 15/50.1 |
| IT | 256323 | | 2/1927 | |

OTHER PUBLICATIONS

Thorne Electric Company, Koblenz Operation Instructions–The Cleaning Machine.
The Malish Corporation, Malish Brush Catalog, 1998.

* cited by examiner

*Primary Examiner*—Mark Spisich
(74) *Attorney, Agent, or Firm*—George M. Medwick

(57) ABSTRACT

An apparatus for cleaning a floor surface having weight support members thereon for carrying the weight of the apparatus into the floor surface includes a brush having a baseplate with an array of bristles. The brush has a plurality of supply passages, each of which communicates with a portion of the bristle array. The brush is loosely attached by a flexible torque transmitting coupling to the shaft for rotation about a centerline of rotation. The brush is attached to a motor shaft in such a way that, in use, the brush is responsive to irregularities in the floor surface as the apparatus is moved thereover by moving in a direction generally parallel to a centerline of rotation and/or in a plane generally perpendicular thereto. A baffle mounted to the top surface of the brush so as to surround the supply passages. In use, a foam cleaning agent is dispensed onto a location on the top surface of the brush inwardly of the supply passages. Rotation of the brush generates a force urging dispensed foam cleaning agent in a radially outwardly direction from the centerline of rotation toward the baffle. The baffled deflects the foam cleaning agent into the supply passages and into the bristles of the brush.

5 Claims, 4 Drawing Sheets

FLOOR CLEANING APPARATUS HAVING A FLOATING BRUSH

FIELD OF INVENTION

This invention relates to an apparatus for cleaning a floor surface, whether a carpeted or a hard surface, and in particular, to a floor surface cleaning apparatus that includes a brush that is loosely attached by a flexible torque transmitting coupling to a shaft for rotation about a centerline of rotation.

BACKGROUND OF THE INVENTION

Currently, most carpet cleaning equipment uses a brush that is rigidly mounted to the drive shaft of the apparatus. In most cases the entire weight of the cleaning apparatus is carried by the brush to the floor surface. The operator tilts the apparatus slightly to change its direction and thus controls the path of the apparatus over the floor surface.

In another form a vertical shaft rotary brush cleaning apparatus is configured with support wheels so that the load of the brush on the floor can be controlled independently of the equipment weight.

A liquid cleaning solution may be either pre-sprayed to the floor or supplied to the floor through the brush drive shaft. In some apparatus, such as that manufactured by Thorne Electric Company, San Antonio, Tex., the liquid cleaning solution is fed by gravity to the brush hub. In apparatus using a rotary brush such as that manufactured by The Malish Corporation, Willoughby, Ohio, liquid cleaning solution is fed by gravity to the top surface of the brush. The brush has an array of openings near its outer perimeter. Cleaning liquid fed onto the hub is allowed to drip into the bristles.

SUMMARY OF THE INVENTION

The present invention is directed toward the form of brush cleaning apparatus having a frame equipped with weight supporting members for carrying the weight of the apparatus into the floor. The apparatus includes a brush that is loosely attached by a flexible torque transmitting coupling to a motor shaft for rotation about a centerline of rotation. The brush is attached to the shaft such that, in use, the brush is responsive to irregularities in the floor surface as the apparatus is moved thereover. The brush is able to move, or"float" on the carpet surface, in a direction generally parallel to centerline of rotation and/or in a plane generally perpendicular thereto.

The flexible torque transmitting coupling includes a drive collar connected to the motor shaft. A plurality of drive rods depend from the drive collar. The drive rods extend through enlarged mounting openings in the brush body. The lower end of each drive rod has a retainer thereon. When the cleaning apparatus is placed on the floor, the brush rises on the drive rods and is ready for the rotary motion.

The brush has a plurality of supply passages formed therein, with each of the supply passages communicating with a portion of the bristle array. A baffle is mounted to the top surface of the brush to surround the supply passages. In use, foam from a foam generator is dispensed onto the top surface of the brush inwardly of the supply passages. Centrifugal force induced by the rotary motion of the brush urges the foam to move radially outwardly toward the baffle. The baffle deflects the foam cleaning agent into supply passages and into the bristles. The foam is scrubbed by the bristles into the carpet surface.

BRIEF DESCRIPTION OF THE DRAWINGS

The invention will be more fully understood from the following detailed description, taken in connection with the accompanying drawings which form a part of this application in which.

DETAILED DESCRIPTION OF THE INVENTION

Figure 1:
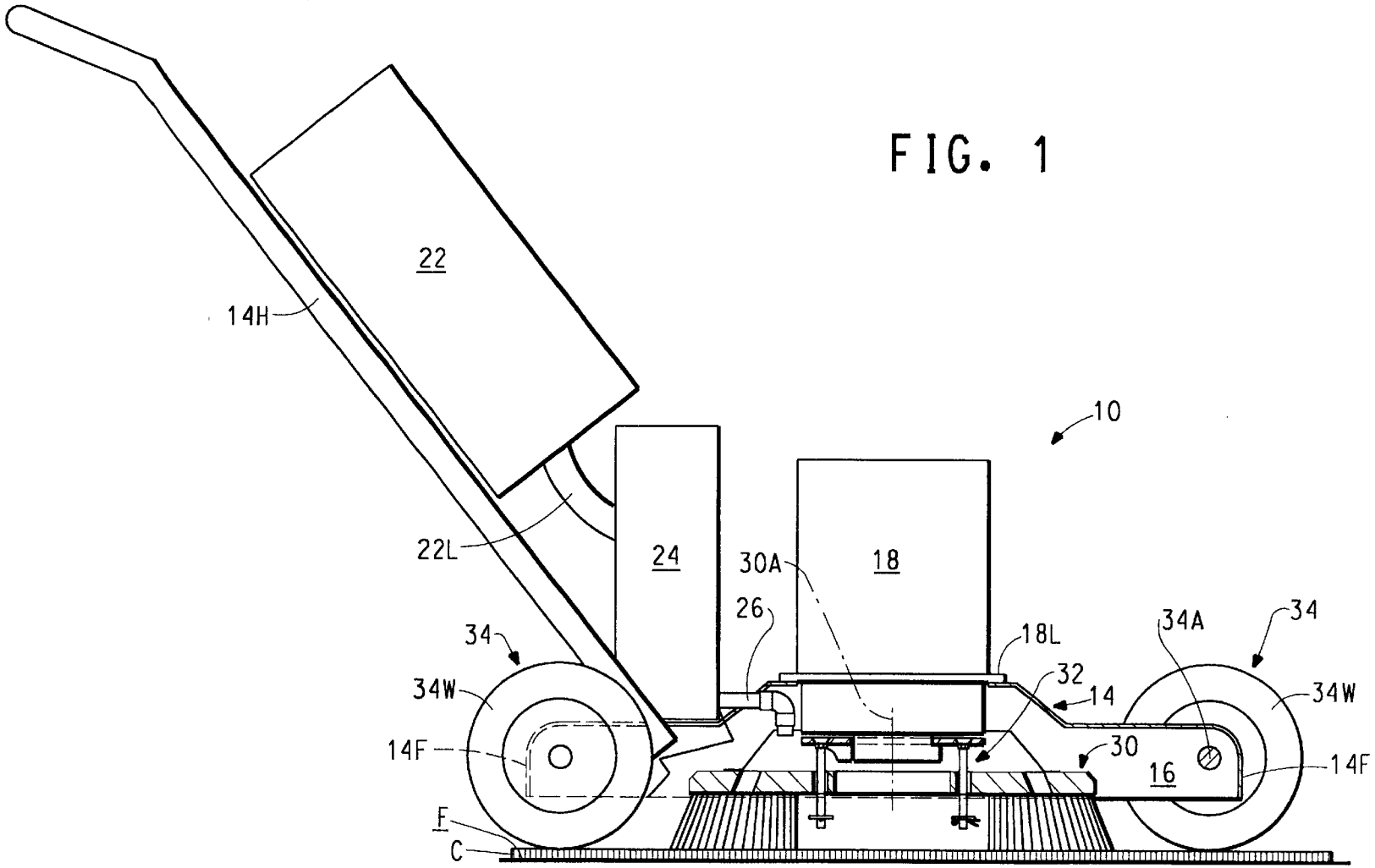
FIG. 1 is a stylized side elevational view, partially in section, of a floor cleaning apparatus in accordance with the present invention.

Throughout the following detailed description, similar reference numerals refer to similar elements in all the figures of the drawings.

FIG. 1 is a stylized representation of an apparatus generally indicated by the reference character 10 in accordance with the present invention for cleaning a floor surface F. Although the apparatus 10 is illustrated and hereinafter described in the context of a floor surface F covered by a carpet C, it should be understood that the apparatus 10 may be used on floor surfaces that are bare or covered by other surface coverings.

Figure 2:
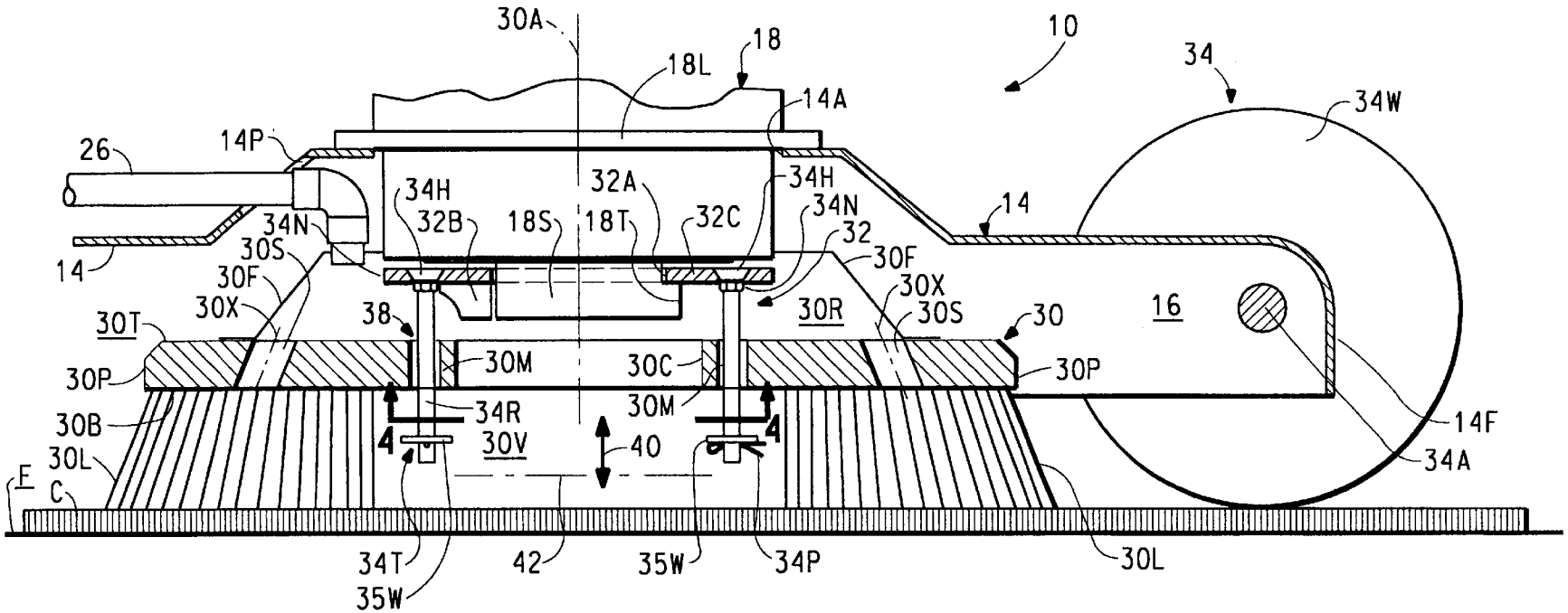
FIG. 2 is an enlarged view of the sectioned portion of the floor cleaning apparatus shown in FIG. 1; and, FIG. 3 is a plan view of a drive collar used in the flexible torque transmitting arrangement of the present invention.

With reference to FIG. 1 and to the more detailed section view of FIG. 2, the floor cleaning apparatus 10 includes a generally dome-like frame 14 having a central opening 14A therein. The margin of the frame 14 is turned downwardly to define a flange 14F that peripherally encloses the working volume 16 disposed beneath the frame 14. The frame 14 is typically fabricated from cast aluminum although other materials such as sheet steel may be used.

A drive motor 18 is mounted to the frame 14 such that the shaft 18S of the motor 18 projects through the opening 14A into the working volume 16. The motor 18 is supported on the frame 14 by a peripheral mounting lip 18L that rests upon and is secured to that portion of the frame 14 defining the aperture 14A. The end of the motor shaft 18S has an array of mounting tangs 18T thereon.

An operating handle 14H (FIG. 1) is movably attached to the frame 14. A supply tank 22 for a foam cleaning solution is conveniently supported on the handle 14H and is connected by a line 22L to a foam generator 24. The foam generator 24 is conveniently mounted to the frame 14. A foam supply pipe 26 from the generator 24 projects into the interior volume 16 through an access port 14P formed in the frame 14. The foam supply pipe 26 is conveniently fabricated from copper piping and copper fittings.

A cleaning brush 30 is connected by a flexible torque transmitting coupling 32 to the drive shaft 18S of the drive motor 18 for rotation within the working volume 16 about a centerline of rotation 30A. The brush 30 includes a generally annular baseplate 30P having a bottom surface 30B and a top surface 30T. A generally annular array of nylon bristles 30L extends from the bottom surface 30B of the baseplate 30P. A suitable brush that may be modified for use with the apparatus 10 of the present invention is a nylon bristle brush available from The Malish Corporation, Willoughby, Ohio.

The baseplate 30P of the brush 30 has an array of mounting openings 30M surrounding the central opening 30C therein. The baseplate 30P may be fabricated from molded plastic or wood. The brush 30 depends from the drive shaft 18S into the working volume 16 beneath the frame 14 such that the bristles 30L are in contact with the floor surface F. The inner boundary of the array of bristles 30L defines a generally enclosed lower volume 30V beneath the baseplate 30P and above the floor surface F.

The baseplate 30P has a plurality of supply passages 30S extending therethrough. Each of the supply passages 30S communicates with a portion of the bristle array 30L. The axis 30X extending through each of the passages 30S is inclined radially outwardly with respect to the centerline of rotation 30A.

A frustoconical baffle 30F is mounted, as by peripheral screws (not shown) to the top surface 30T of the baseplate 30P. The baffle 30F, which may be fabricated of sheet metal or plastic, generally encloses a region 30R lying above the top surface of the baseplate 30P. Preferably, the baffle 30F is positioned on the baseplate 30P such that the lower edge of the baffle lies radially outwardly of the radially outer edge of each of the supply passages 30S. In this way the region 30R communicates with the supply passages 30S in the baseplate 30P.

The apparatus 10 is supported on and is transportable over the floor surface F on a plurality of weight support members generally indicated by the reference character 34. The weight support members 34 serve to carry the weight of the frame 14, the motor 18, the supply tank 22, the foam generator 24, and any other appurtenances that may be disposed on the frame 14, and to transmit that burden into the floor surface F. Since the burden of the apparatus 10 is transmitted the into the floor F by the weight support members 34, the bristles 30L in contact with the floor surface F are subjected only to the weight of brush 30.

In the embodiment illustrated the weight support members 34 are implemented using wheels 34W that are rotatably mounted on axles 34A carried by the frame 14. Although the support function is implemented in the illustrated embodiment by the wheels 34W it should be understood that a cleaning apparatus 10 in accordance with the present invention may utilize any alternate weight support and transport arrangement, such as rollers, tracks, slides or any other convenient mechanism.

Figure 3:
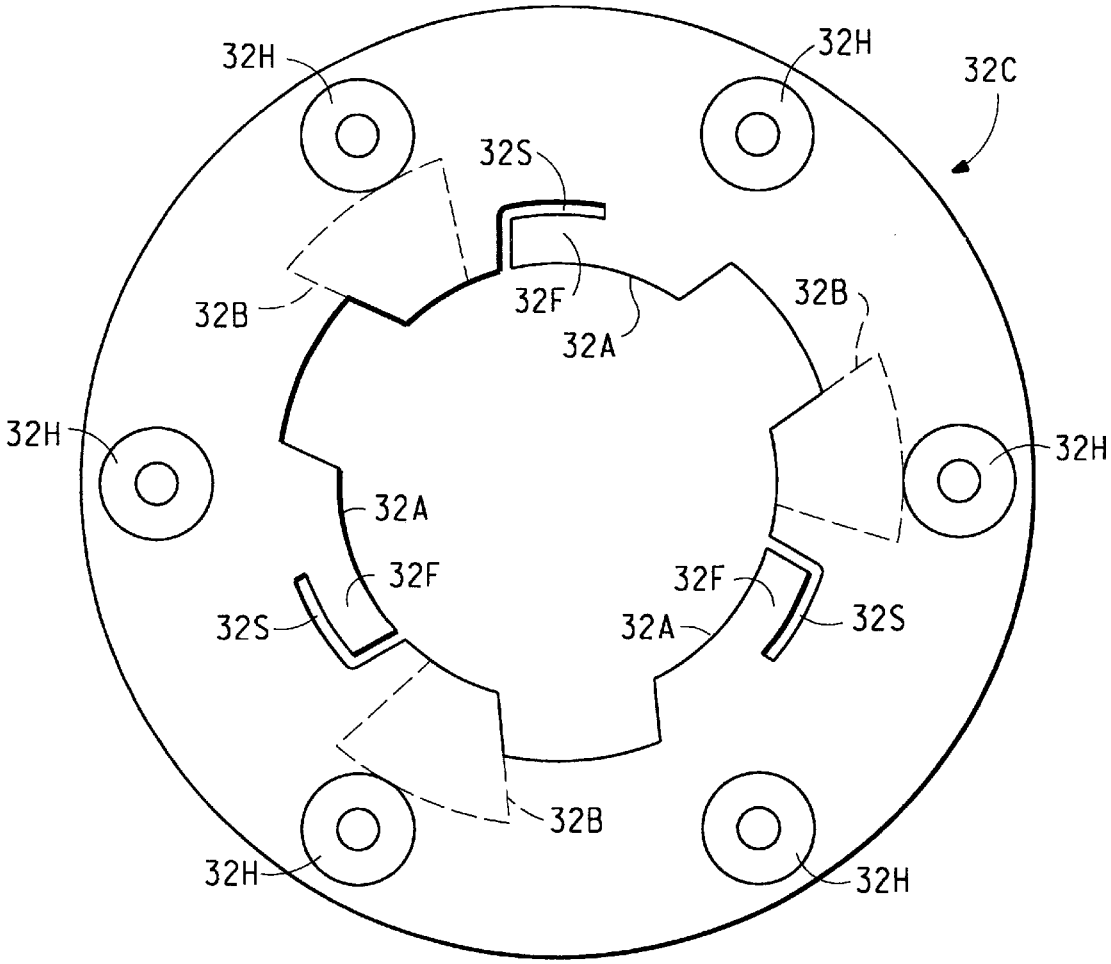
Figure 4:
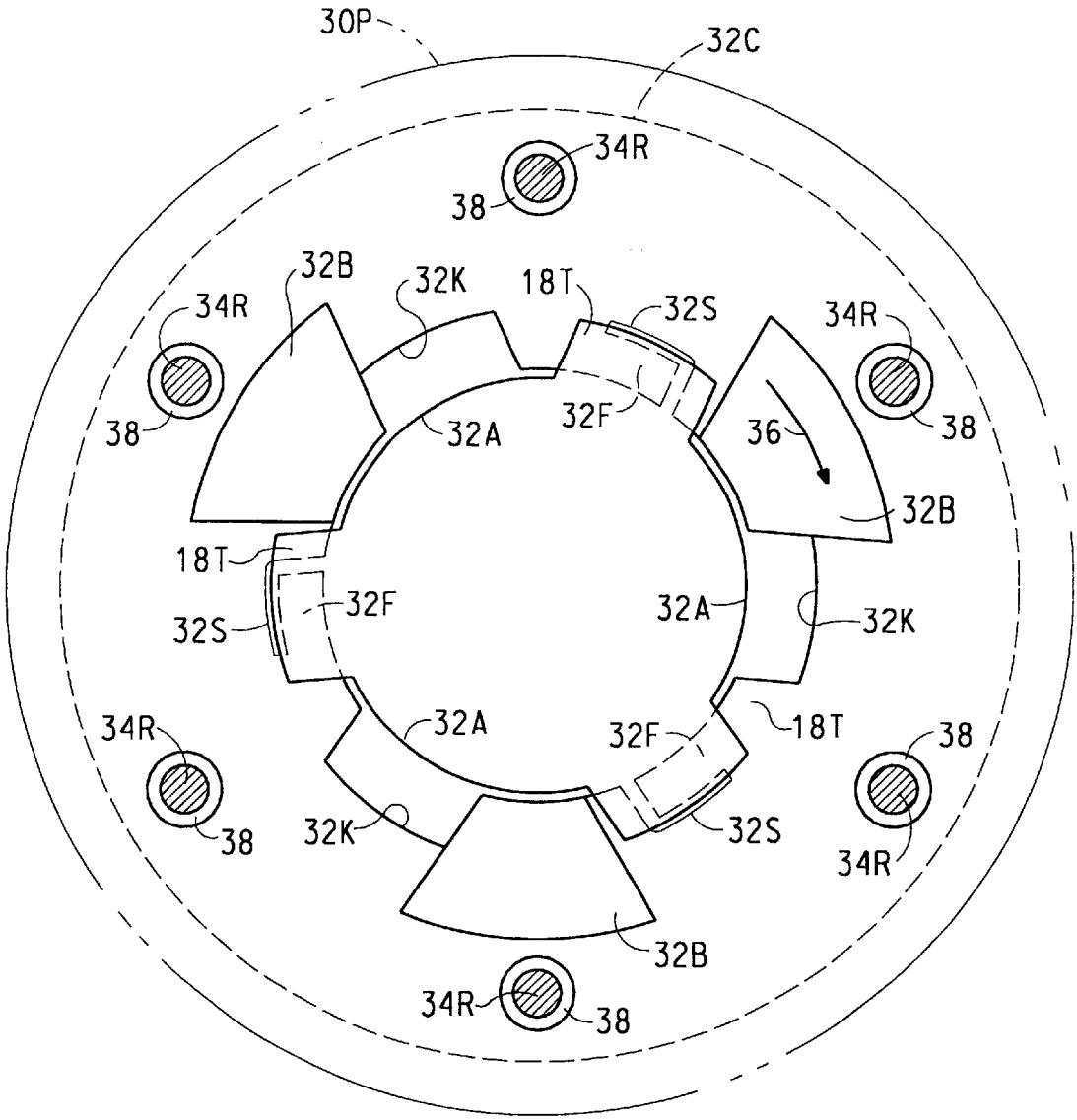
FIG. 4 is section view taken along section lines 4—4 in FIG. 2.

The flexible torque transmitting coupling 32 by which the brush 30 is loosely attached to the shaft 18S for rotation about the centerline of rotation 30A is best described in connection with FIGS. 2 through 4.

The main element of the torque transmitting coupling 32 is a drive collar 32C generally similar to the drive member sold by The Malish Corporation, Willoughby, Ohio, under part number NP-9200. The drive collar 32C is a flat, generally annular member formed from molded plastic having a central opening 32A. As best seen in the plan view of FIG. 3 the collar 32C has an array of equiangularly spaced tapered openings 32H formed therein. Cut-outs 32K are provided on the inner edge 32A of the drive collar 32C. Slots 32S communicating with the central opening of the collar 32C serve to define generally circumferentially extending flexible fingers 32F for a purpose to be described. The lower surface of the collar has abutments 32B threron.

A plurality of drive rods 34R extend through the collar 32C. Each drive rod 34R has a predetermined overall length dimension associated therewith. Each of the drive rods 34R has a tapered head 34H that is received in one of the tapered openings 32H. When received by the collar 32C, the heads 34H of the rods 34R lie flush with the upper surface of the collar 32C, and the elongated body portions 34B depend from the lower surface of the collar 32C. Each rod is secured by a nut 34N. Each rod 34R terminates at its lower end with a retainer 34T. The retainer 34T is configured from a washer 35W held by a pin 34P.

To attach the brush 30 to the shaft 18S, the cutouts 32K on the drive collar 32C are angularly registered with the tangs 18T on the shaft 18S. The collar 32C may then be slid axially onto the shaft 18S. When the tangs 18T are adjacent to the lower surface of the collar 32C, the collar 32C is rotated in the direction of arrow 36 shown in the bottom view of FIG. 4. This relative rotation the collar 32C with respect to the shaft 18S brings the tangs 18T on the shaft into angularly abutting relationship with the abutments 32B on the undersurface of the collar 32C. As the tangs 18T are rotated into position the tangs 18T engage and flex the fingers 32F slightly above the surface of the collar 32C. This flexing of the fingers 32F generates a spring-like holding force drive which tends to maintain the shaft 18S and the collar 32C in engagement.

With the collar 32C attached to the shaft 18S each of the drive rods 34R passes through one of the mounting openings 30M in the baseplate 30P. The rods are diametrically sized such that the rods pass through the baseplate with a predetermined clearance distance 38 (FIG. 2) being defined between the rods 34R and the baseplate 30P.

The predetermined length dimension of the rods 34R is sized so that when the frame 14 is supported by the wheels 34W the brush 30 rides upwardly along the rods 34R. In this position, the retainers 34T at the lower end of each of the rods 34R lie below the bottom surface of the baseplate and the bristles 30L lie in contact with the floor surface.

With the supply tank filled and the brush mounted to the shaft in the manner described, the apparatus 10 is ready for use. In use, foam is generated by the foam generator and dispensed from the feed tube onto a dispensing location on the top surface of the brush inwardly of the supply passages. The foam is retained in the region 30R formed above the brush 30. The operator moves the apparatus 10 over the surface F to be cleaned.

Torque of the shaft 18S is transferred to the brush through the collar 32C and the drive rods 34R. As the brush 30 rotates a centrifugal force is generated which urges the foam dispensed onto the upper surface of the brush in a radial outwardly direction from the centerline of rotation toward the supply passages. The foam collects against the inner surface of the baffle and is forced downwardly and outwardly, through the supply passages, into the bristles and into contact with the floor. A constant supply of foam maintains a layer of cleaning solution on the carpet surface as the apparatus is moved along the floor in a straight-line motion. It is believed that foam applied directly to the bristles during scrubbing is the most effective way to achieve both penetration and cleaning.

The diameter of the supply passages must be sufficiently large so that the foam can move through freely. In practice, passages having a diameter on the order of 0.75 inches are sized sufficiently to pass a relatively dry foam into the bristles 30L.

Owing to the flexible attachment of the brush 30 to the shaft 18S, as the apparatus 10 is moved over the floor surface F being cleaned, the brush 30 is able to respond to irregularities in the floor surface F by moving in a directions 40 (FIG. 2) generally parallel to centerline of rotation and/or in a plane 42 (FIG. 2) generally perpendicular thereto. Thus, as the brush moves over the floor it rides on the floor it will conform to any irregularities that might otherwise not be addressed if the brush were rigidly attached to the machine.

To change direction, the apparatus is tilted backwardly by an operator a sufficient distance to clear the front wheels and effect the desired turn. While the brush is tilted, the brush 30 settles onto and is carried by the retainer 34T at the lower end of the drive rods 34R. When the turn is completed the full weight of the apparatus 10 is lowered onto the wheels 34W and the brush rides upwardly on the rods 34R so that the bristles 30L again engage the floor F. The cleaning brush 30 is thus in contact with the floor F at all times unless the machine is tilted back as required to change direction of travel.

Since, in accordance with this invention the brush is subjected only to its own weight, it is unnecessary for the operator to set the vertical adjustment or load. As a result, the risk of excessive loading being imposed into the carpeted surface is minimized. In addition, allowing the brush to float on the surface is believed to improve both cleaning uniformity and cleaning efficacy.

Those skilled in the art, having the benefit of the teachings of the present invention as hereinabove set forth may effect numerous modifications thereto. Any such modifications should be construed as lying within the contemplation of the present invention, as defined by the appended claims.

What is claimed is:

1. In an apparatus for cleaning a floor surface, the apparatus including a frame having weight support members thereon, and a drive motor having a shaft extending therefrom, the weight support members carrying the weight of the frame and motor to the floor surface;

the improvement comprising:

a brush having a baseplate with a bottom and a top surface, an array of bristles extending from the bottom surface of the baseplate, a plurality of supply passages extending through the baseplate, each of the passages communicating with a portion of the bristle array;

the brush being loosely attached by a flexible torque transmitting coupling to the shaft for rotation about a centerline of rotation, the brush being attached to the shaft in such a way that, in use, the brush is responsive to irregularities in the floor surface as the apparatus is moved thereover by moving in a direction generally parallel to centerline of rotation and/or in a plane generally perpendicular thereto;

a baffle mounted to the top surface of the baseplate so as to surround the supply passages; and a foam generator adapted to dispense a foam cleaning agent onto a location on the top surface of the brush inwardly of the supply passages, whereby, in use, rotation of the brush generating a force urging dispensed foam cleaning agent in a radially outwardly direction from the centerline of rotation toward the baffle, the baffle deflecting the foam cleaning agent into the supply passages and into the bristles of the brush.

2. The apparatus for cleaning a floor surface of claim 1 wherein the baseplate has an array of mounting openings therein, and wherein the torque transmitting coupling includes collar secured to the motor shaft, the collar having a plurality of drive rods depending therefrom, each of the mounting openings is sized such that the rods pass through the baseplate with a predetermined clearance distance being defined between the rods and the baseplate.

3. The apparatus for cleaning a floor surface of claim 2 wherein the rods have a lower end and a predetermined length dimension, the predetermined length dimension being sized such that when the frame is supported by the weight support members so that the bristles are in contact with the floor surface the lower end of each of the rods lies below the bottom surface of the baseplate.

4. The apparatus for cleaning a floor surface of claim 3 further comprising a retainer connected to the lower end of each of the rods.

5. The apparatus for cleaning a floor surface of claim 1 wherein each of the supply passages has an axis extending therethrough, the axis of each supply passage being inclined radially outwardly with respect to the centerline of rotation.

* * * * *